US011268763B1

(12) United States Patent
Olver et al.

(10) Patent No.: US 11,268,763 B1
(45) Date of Patent: Mar. 8, 2022

(54) ELECTRIC ARC AND LADLE FURNACES AND COMPONENTS

(71) Applicants: Emisshield, Inc., Blacksburg, VA (US); Melter S.A. de C.V., Apodaca (MX)

(72) Inventors: John W. Olver, Blacksburg, VA (US); Timothy Wayne Wilson, Christiansburg, VA (US); Carlos Uribe, San Pedro (MX); Alberto Rivera, Monterrey (MX)

(73) Assignees: Emisshield, Inc., Blacksburg, VA (US); Melter S.A. de C.V., Apodaca (MX)

( * ) Notice: Subject to any disclaimer, the term of this patent is extended or adjusted under 35 U.S.C. 154(b) by 733 days.

(21) Appl. No.: 15/857,608

(22) Filed: Dec. 28, 2017

(51) Int. Cl.

| | |
|---|---|
| ***F27D 1/00*** | (2006.01) |
| ***F27D 11/08*** | (2006.01) |
| ***B05D 7/14*** | (2006.01) |
| ***B05D 1/02*** | (2006.01) |

(52) U.S. Cl.
CPC ..... *F27D 1/0033* (2013.01); *B05D 1/02* (2013.01); *B05D 7/14* (2013.01); *F27D 11/08* (2013.01); *F27D 2001/0069* (2013.01)

(58) Field of Classification Search
CPC ..... F27D 2001/0069; F27D 11/08; F27D 1/0033; B05D 7/14; B05D 1/02
USPC ..... 373/71
See application file for complete search history.

(56) References Cited

U.S. PATENT DOCUMENTS

| | | | | |
|---|---|---|---|---|
| 4,422,625 | A * | 12/1983 | Thurn | F27D 1/1626 266/275 |
| 6,596,120 | B2 | 7/2003 | Davis et al. | |
| 7,104,789 | B1 | 9/2006 | Robich et al. | |
| 7,105,047 | B2 | 9/2006 | Simmons et al. | |
| 8,840,942 | B2 | 9/2014 | Olver et al. | |
| 2017/0204273 | A1 * | 7/2017 | Doherty | C09D 7/61 |

FOREIGN PATENT DOCUMENTS

| | | | |
|---|---|---|---|
| JP | 2000160474 | A | 6/2000 |
| JP | 2014073950 | A | 4/2014 |
| WO | 1992005343 | A1 | 4/1992 |

* cited by examiner

*Primary Examiner* — Dana Ross
*Assistant Examiner* — Joseph W Iskra
(74) *Attorney, Agent, or Firm* — Johnston Holroyd; Mary-Jacy Holroyd

(57) ABSTRACT

Electric arc, and ladle, furnaces 10 have components 14 with a high-emissivity/high reflectivity layer 18 disposed on the hot face 16. The component 14 includes a water-cooled panel 40, a duct 34, roof 12 frame 38, pipes, dry delta 36, water-cooled delta 28, fourth hole elbow 32, fourth hole roof 42, side walls 26 and combinations thereof. The high-emissivity/high-reflectivity layer 18 comprises, in dry admixture, from about 5% to about 40% of an inorganic adhesive, from about 45% to about 92% of a filler, and from about 1% to about 25% of one or more emissivity agents.

19 Claims, 10 Drawing Sheets

FIG. 2A
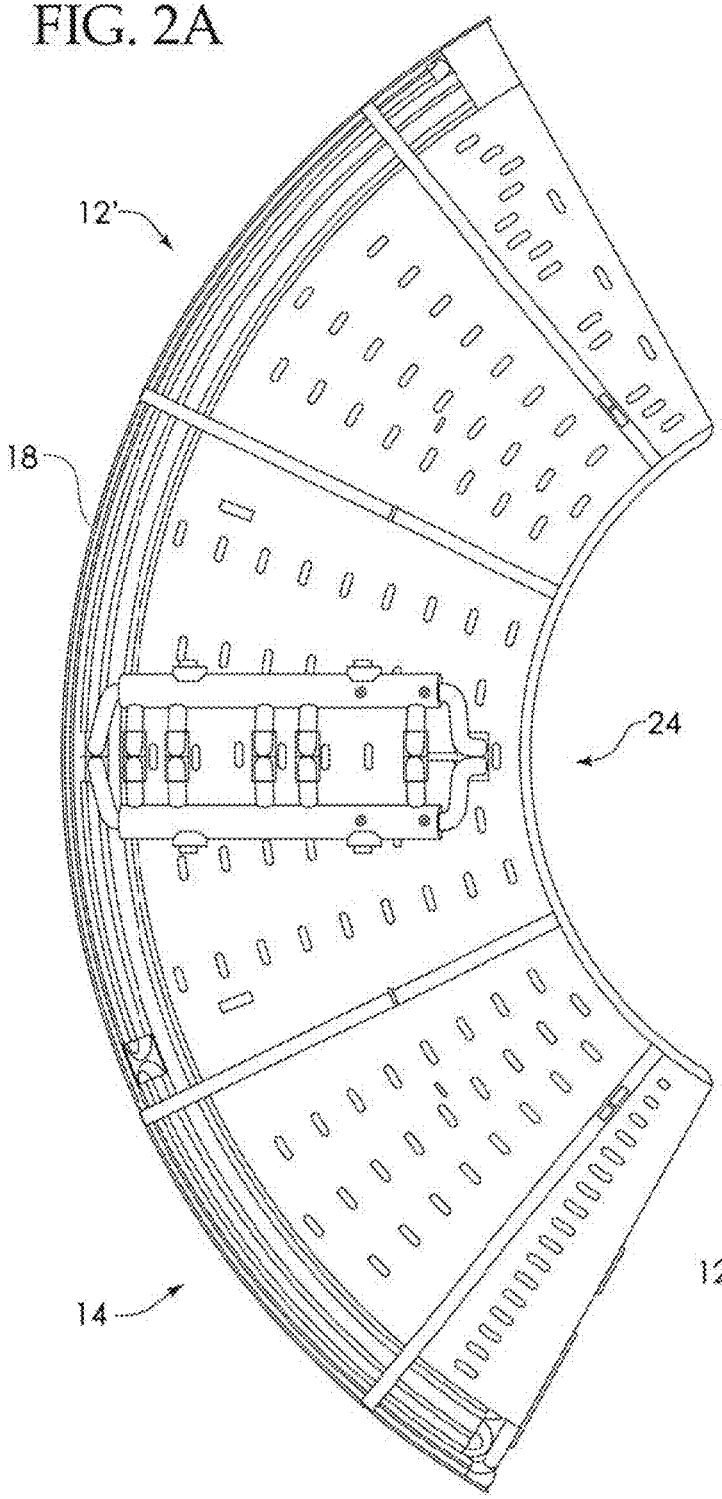
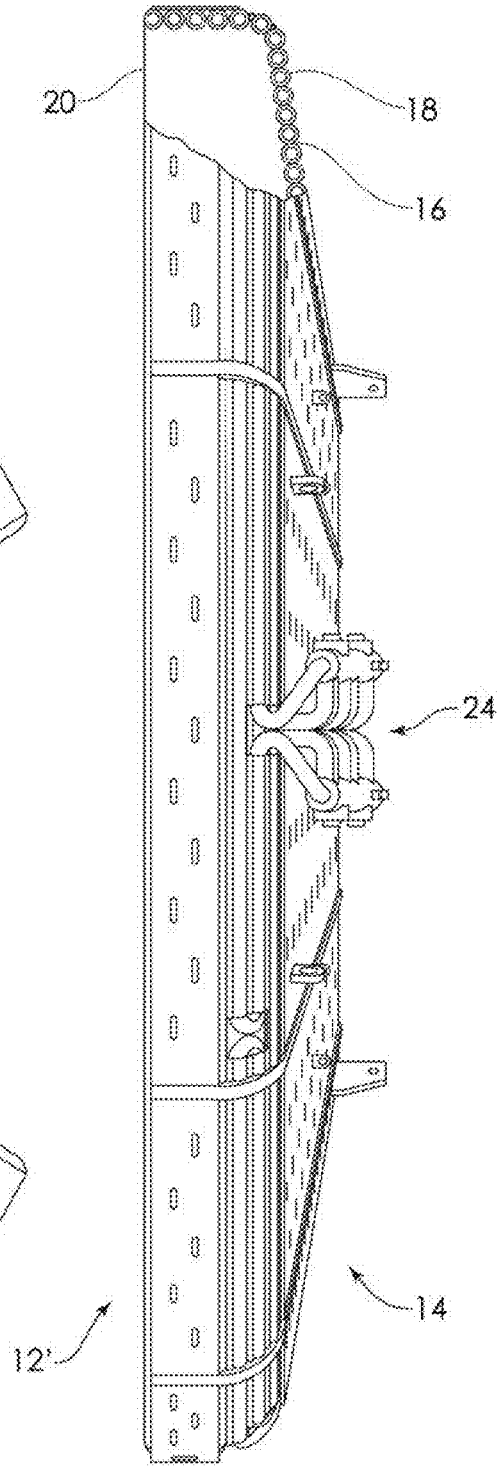
FIG. 2B

ELECTRIC ARC AND LADLE FURNACES AND COMPONENTS

COPYRIGHT NOTICE

A portion of the disclosure of this patent document may contain material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

BACKGROUND OF THE INVENTION

A. Field of the Invention

The present invention is related electric arc and ladle furnaces and more particularly to components for electric arc and ladle furnaces having a coating system that provides its hot surfaces with an increase of hemispherical and spectral emissivity and an increase of the dielectric constant.

B. Description of the Related Art

Electric arc furnaces and ladle furnaces use electrodes to either melt steel or to maintain the temperature of molten metal for refining. Both furnaces have water-cooled roofs that either use pressurized pipes or a water sprayed enclosure. Additional components of such furnaces included water-cooled/dry delta, smoke rings, and sidewalls, which together with the roof panels form the furnace upper-shelf. The fourth-hole elbow and ducts form the exhaust cooling system. Each furnace has two faces, one to the inside of the furnace, called the "hot face", and one to the outside of the furnace, which is called the "cold face".

Water cooling system composing of water cooled panels, water cooled roof and water-cooled elbow is an integral part in the operation of an electric arc furnace. The water-cooled panels, are used in electric arc furnaces for the shell walls and roof thereof. Said panels close the furnace to maintain the high temperatures necessary to melt steel. However, the panels are made of steel, so water is used to keep them at optimum operating temperature.

Typically, there are several water-cooled systems. Some operations require extremely clean, high quality cooling water. Transformer cooling, delta closure cooling, bus tube cooling and electrode holder cooling are all such applications. These systems will consist of a closed loop circuit, which conducts water through these sensitive pieces of equipment. The water in the closed loop circuit passes through a heat exchanger to remove heat. The circuit on the open loop side of the heat exchanger flows to a cooling tower for energy dissipation. The water-cooled elements such as water-cooled panels, water-cooled roof panels, water-cooled off-gas system ducting, water-cooled furnace cage etc. will receive cooling water from a cooling tower.

The cooling circuit consists of supply pumps, return pumps, filters, a cooling tower cell or cells and flow monitoring instrumentation. Sensitive pieces of equipment normally have instrumentation installed to monitor the cooling water flow rate and temperature. For most water-cooled equipment, interruption of the flow or inadequate water quantities can lead to severe thermal over loading and in some cases catastrophic failure.

There are basically two kinds of water cooled systems: pressurized water cooling systems and water spray cooling systems. The most common problems for the pressurized water-cooled systems (using water ducts/pipes) include thermal fatigue due to heating/cooling cycles, electric arc or arcing, and reduced efficiency (due to cooling). The elements of the pressurized water-cooled systems tend to be damaged by thermal fatigue due to the constant cycles of heating and abrupt cooling which can generate water leakages inside the furnace. Sometimes the elements of the system are damaged by electric arcing which may break the walls of the panels causing water leaks that require major repairs and unscheduled line stops. The constant cooling of the panels, removes heat from the steel casting process, which reduce the efficiency of the process.

The most common problems with regard to the water spray cooling systems, include the low pressure environment in which it operates cools the system, electric arcing, and thermal fatigue. The system is designed to work under low pressure, which reduces the risks of large water leaks into the furnace, however the system also removes a large amount of heat from the steel casting process, which could be used to increase furnace thermal efficiency. The system is designed to work under low pressure, which reduces the risks of large water leaks into the furnace, however the system also removes a large amount of heat from the steel casting process, which could be used to increase thermal efficiency. The system is susceptible to damage by electric arcing. To a lesser extent, the system also suffers from thermal fatigue which cause deformations in the construction of the water-cooled panels.

An example of furnace elements that are cooled by pressurized water-cooled system are the exhaust ducts having pressurized water-cooled panels for cooling the hot gases exiting the electric arc furnace during the casting process. Such ducts suffer a significant damage due to the extreme operating conditions. Some of the damages that results include corrosion and abrasion. The high content of chemicals potentially found in the gases exiting the electric arc furnace are a source of corrosion. The fact that the inner walls of the exhaust ducts are at a low temperature facilitates corrosion. The resultant corrosive assault on the metal surface permanently damages it, and generates weak points which may cause water leakage. Similarly, abrasion due to the presence of particles suspended in the exhaust gases of the electric arc furnace results in damage. The cooled ducts are susceptible to abrasion damage as the particles travel at high speeds colliding with the inner walls of the ducts.

Prior art documents describing water cooled exhaust ducts having a high emissivity coating are disclosed in the prior art documents Nos. U.S. Pat. No. 7,104,789, WO/1992/005343, U.S. Pat. No. 6,596,120B2, U.S. Pat. No. 6,596,120B2, JP2000160474A, and JP2014073950, however, none of the water-cooled furnace components described in those documents show dielectric properties that would avoid damages by electric arcing such as described above. Nor are they confirmed by spectral and hemispherical emissivity measurements.

In view of the above referred problems, the applicant developed water cooled panels for electric arc furnaces, such as shell and roof panels of an electric arc furnace including smoke-ring and cooled exhaust ducts having a coating that provides their surface with an increase of the hemispherical and spectral emissivity, and with an increase of the dielectric constant.

The coating radiates the heat absorbed by the walls directly into the molten steel, preventing heat from being absorbed by the cooling water circulating inside the panel, thereby increasing the thermal efficiency of the process. This in turn reduces the arc time (the time in which the electric arc is active generating heat) which results in electrical energy savings, less damage to the electrodes and therefore longer life, and less damage to the water-cooled panels thanks to the dielectric properties provided by the coating and the lower operating temperature of the water inside the panels.

SUMMARY OF THE INVENTION

The present invention is drawn to electric arc and ladle furnaces 10 which have water-cooled roofs 12 using electrodes to either melt steel, or maintain the temperature of molten metal, for refining. Both electric arc furnaces and ladle furnaces 10 use electrodes to heat/maintain molten steel. Each such furnace 10 uses various components 14 which have a hot face 16, and a high-emissivity/high reflectivity layer 18 disposed on the hot face 16. The cold face 20, may also be coated. Each furnace 10 has a water-cooled roof 12. The water-cooled roofs 12 use either a sprayed enclosure 24, or pressurized pipes 24, to provide coolant. Additional components 14 include the sidewalls 26 and water-cooled delta 28. An exhaust cooling system 30 has a fourth-hole elbow 32 and ducts 34. The sidewalls 26 and water-cooled delta 28 which together with roof 12 panels 40 form the furnace upper-shell. The furnaces 10 have high-emissivity/high-reflectivity layer 18 disposed on the hot faces 16 of these features and components 14 of the electric arc furnaces 10 and ladle furnaces 10. The high-emissivity/high-reflectivity coatings 18 are applied on the hot face 16 of these elements to form the high-emissivity layer 18.

The high-emissivity/high-reflective coating 18 is applied to the entirety of the hot face 16 to improve the properties of the metal surface. Water cooled components 14 include roof 12 panels 40, delta 28, upper shell panels 40, fourth-hole elbow 32, and ladle roof 12. The roof 12 panels 40, both sprayed and duct, have the hot face 16 coated. The water-cooled delta 28 and the dry delta 36 are coated in its entirety. The upper shell panels 40 for both spray and duct have only the hot face 16 coated. The fourth-hole elbow 32 in both sprayed and duct have the hot face 16 coated. For both spray and duct 34, only the hot face 16 is coated. Only the hot face 16 of the ladle roof 12 is coated. The dry elements include the delta 36, which is coated in its entirety.

Electric arc furnaces 10 and ladle arc furnaces 10 benefit from increased component 14 life, reduced wear, reduced component 14 thermal fatigue, and reduced arc time which may translate into more productivity at a lower energy cost per ton of steel produced.

An aspect of the present invention is that the roof 12 and side-wall panels 40 have increased emissivity/reflectivity, reduction of energy loss through cooling water, and increased dielectric properties to reduce arcing. Furthermore, the ladle furnace roof 12 has increased life through reduced thermal cycling, and reduced slag accumulation which eliminates interference problems. Water cooled electric arc furnace roof 12' has increased life through the elimination of arcing, and reduced slag accumulation and increased thermal performance.

An aspect of the present invention is that the dry and water-cooled delta 36 and 28 has improve the life, and reduced arcing on the both dry and water-cooled deltas 36 and 28. The dry delta 36 also has an increased life through improved thermal performance. The water-cooled delta 28 has an increased life through elimination of arcing.

An aspect of the present invention is that the fourth-hole elbow 32 and water-cooled ducts 34 have improved corrosion resistance, and improved cooling capability. The fourth hole elbow 32 has increased life through reduced corrosion.

The sidewall panel 40 has reduced slag accumulation and increased thermal performance. The ductwork 34 has increased life through reduced corrosion It is therefore a main object of the present invention, to provide water cooled panels 40 for electric arc furnaces 10 such as: shell and roof 12 panels 40 of an electric arc furnace 10 including smoke-ring and cooled exhaust ducts 34 having a coating 18 that provides their surface hot face 16 or cold face 20 with an increase of the hemispheric/spectral emissivity and with an increase of the dielectric constant.

It is another main object of the present invention, to provide water cooled panels 40 for electric arc furnaces 10 of the above referred nature, in which the coating radiates the heat absorbed by the roof and walls directly into the molten steel, preventing heat from being absorbed by the cooling water circulating inside the panel 40, thereby increasing the thermal efficiency of the process.

It is still a main object of the present invention, to provide water cooled panels 40 for electric arc furnaces 10 of the above referred nature, which reduces the arc time (the time in which the electric arc is active generating heat) which results in electrical energy savings, less electrode consumption and therefore longer life.

It is another object of the present invention, to provide water cooled panels 40 for electric arc furnaces 10 of the above referred nature, in which the coating system provides dielectric properties to the surface of the water-cooled panels 40, thus reducing damages by electric arcing.

These and other objects and advantages of the coated 18 water-cooled panels 40 for electric arc furnaces 10 of the present invention will become apparent to those persons having an ordinary skill in the art, from the following detailed description of the embodiments of the invention which will be made with reference to the accompanying drawings.

BRIEF DESCRIPTION OF THE DRAWINGS

The novel features of the described embodiments are specifically set forth in the appended claims; however, embodiments relating to the structure and process of making the present invention, may best be understood with reference to the following description and accompanying drawings.

FIGS. 2A-2B are top and side views respectively of a water-cooled roof 12' with a high-emissivity/high-reflectivity layer 18 disposed thereon according to an embodiment of the present design.

Similar reference characters denote corresponding features consistently throughout the attached drawings.

DETAILED DESCRIPTION OF PREFERRED EMBODIMENTS

Figure 1A:
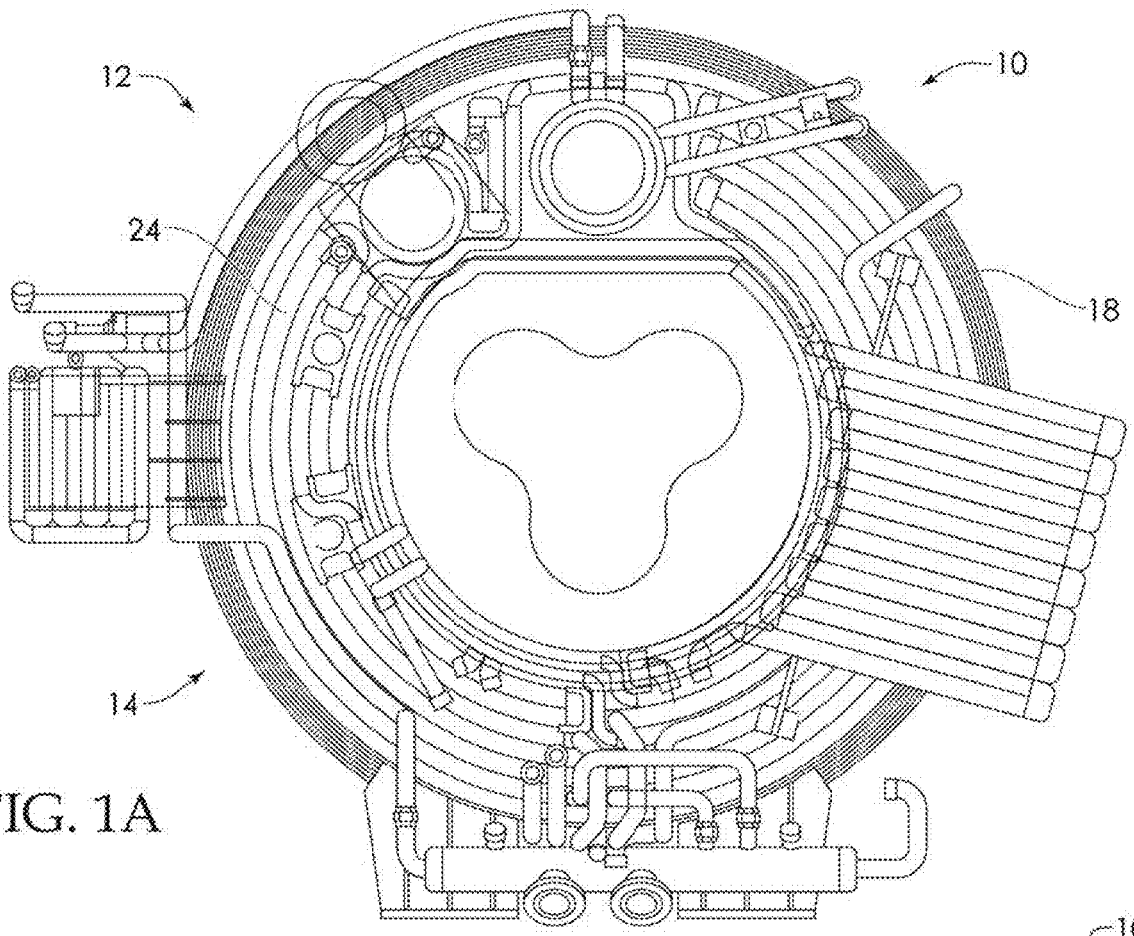
FIGS. 1A-1B are top and side views respectively of a ladle furnace roof 12 with a high-emissivity/high-reflectivity layer 18 disposed thereon according to an embodiment of the present design.

The coated components 14 for electric arc or ladle furnaces 10 of the present invention may comprise shell and roof 12 panels 40 including smoke-ring and cooled exhaust ducts 34. The panels 40 that are coated with the high emissivity//high reflectivity and high dielectric constant coating systems are the panels 40 that form the interior of the furnace or the exhaust duct 34, and the surfaces that are coated, are the surfaces that face the interior of the furnace or the exhaust duct 34 (hot surfaces), that is, the surfaces that are oriented to the hottest portions of the furnace and that are subject to extreme operating conditions.

Figure 1B:
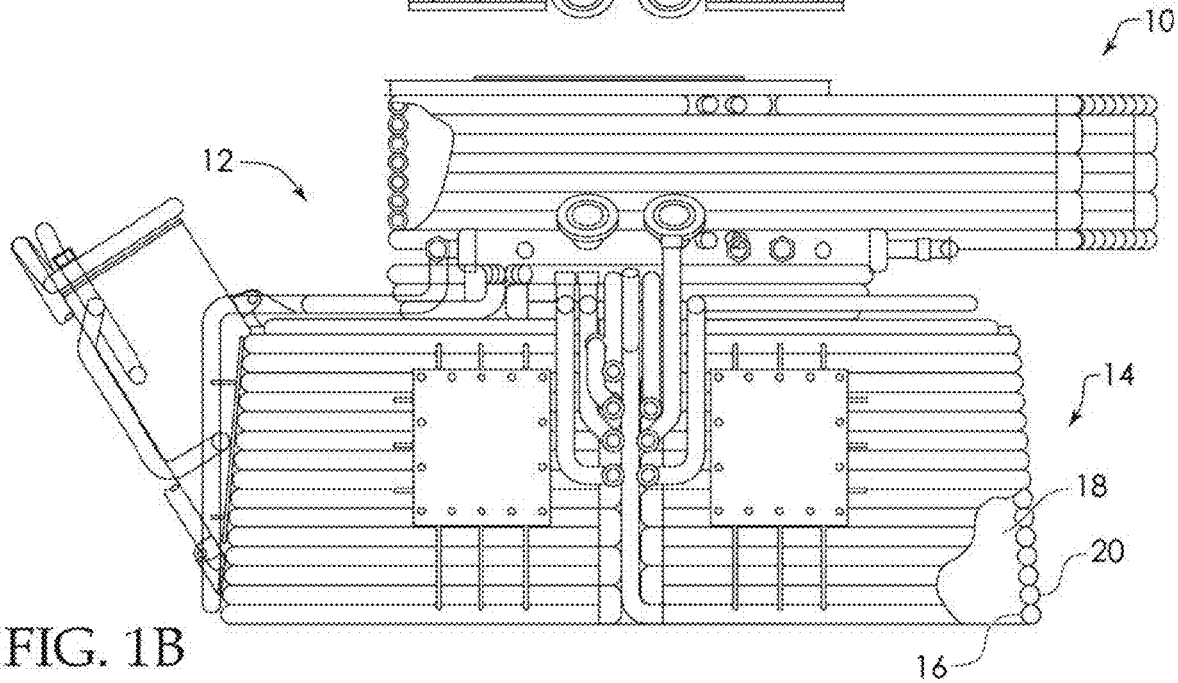

The water-cooled roofs 12 use either a sprayed enclosure 24, or pressurized pipes 24, to provide coolant. FIGS. 1A-1B are top and side views respectively of a ladle furnace roof 12 with a high-emissivity/high-reflectivity layer 18 disposed thereon according to an embodiment of the present design showing the pressurized pipes through which cooling water is circulated under high pressure. FIG. 1B shows the hot face 16 and cold face 20 sides. FIGS. 2A-2B are top and side views respectively of a water-cooled roof 12' which is a water sprayed cooled, and has a high-emissivity/high-reflectivity layer 18 disposed on the hot face thereof according to an embodiment of the present design.

The coating system used on the hot surface of the water-cooled panel 40 has the following properties: thermal conductivity of 1.4 W/m/K at 350° C., emissivity of 0.85 to 0.95 at 2000° F., and a dielectric constant of K=3.9 at 1 HZ.

The high emissivity/high reflectivity layer 18 may be comprised, in a preferred embodiment of the invention, by a coating composition such as the one described in the U.S. Pat. No. 7,105,047 B2, the contents of which are included herein by reference in its entirety. The high emissivity/high reflectivity layer 18 used is comprised of, in dry admixture, from about 5% to about 40% of an inorganic adhesive taken from the group consisting of an alkali/alkaline earth metal silicate taken from the group consisting of sodium silicate, potassium silicate, calcium silicate, and magnesium silicate; from about 45% to about 80% of a filler taken from the group consisting of silicon dioxide, aluminum oxide, titanium dioxide, magnesium oxide, calcium oxide, and boron oxide; and from about 1% to about 25% of one or more emissivity agents taken from the group consisting of silicon hexaboride, boron carbide, silicon tetraboride, silicon carbide (powder), molybdenum disilicide, cerium oxide, tungsten disilicide, zirconium diboride, zirconium carbide, hafnium carbide, hafnium diboride, cupric chromite, and metallic oxides.

When the emissivity agents are one or more metallic oxides, they are taken from the group consisting of iron oxide, magnesium oxide, manganese oxide, copper chromium oxide, chromium oxide, cerium oxide, terbium oxide, and derivatives thereof. The filler is a fine particle size refractory material taken from the group consisting of silicon dioxide, aluminum oxide, titanium dioxide, magnesium oxide, calcium oxide and boron oxide. The emissivity agent(s) is (are) taken from the group consisting of silicon hexaboride, boron carbide (also known as carbon tetraboride), silicon tetraboride, silicon carbide, molybdenum disilicide, tungsten disilicide, zirconium diboride, zirconium carbide, hafnium carbide, hafnium diboride, cupric chromite, and, combinations and derivatives thereof. The metallic oxides are taken from the group consisting of iron oxides, magnesium oxides, manganese oxides, copper chromium oxides, chromium oxides, cerium oxides, terbium oxides, and combinations thereof. The coating may have, in dry admixture, from about 1.5% to about 5.0% of a stabilizer taken from the group consisting of bentonite, kaolin, magnesium alumina silica clay, tabular alumina, and stabilized zirconium oxide. Bentonite is a preferred option. A surfactant may also be used.

Figure 3A:
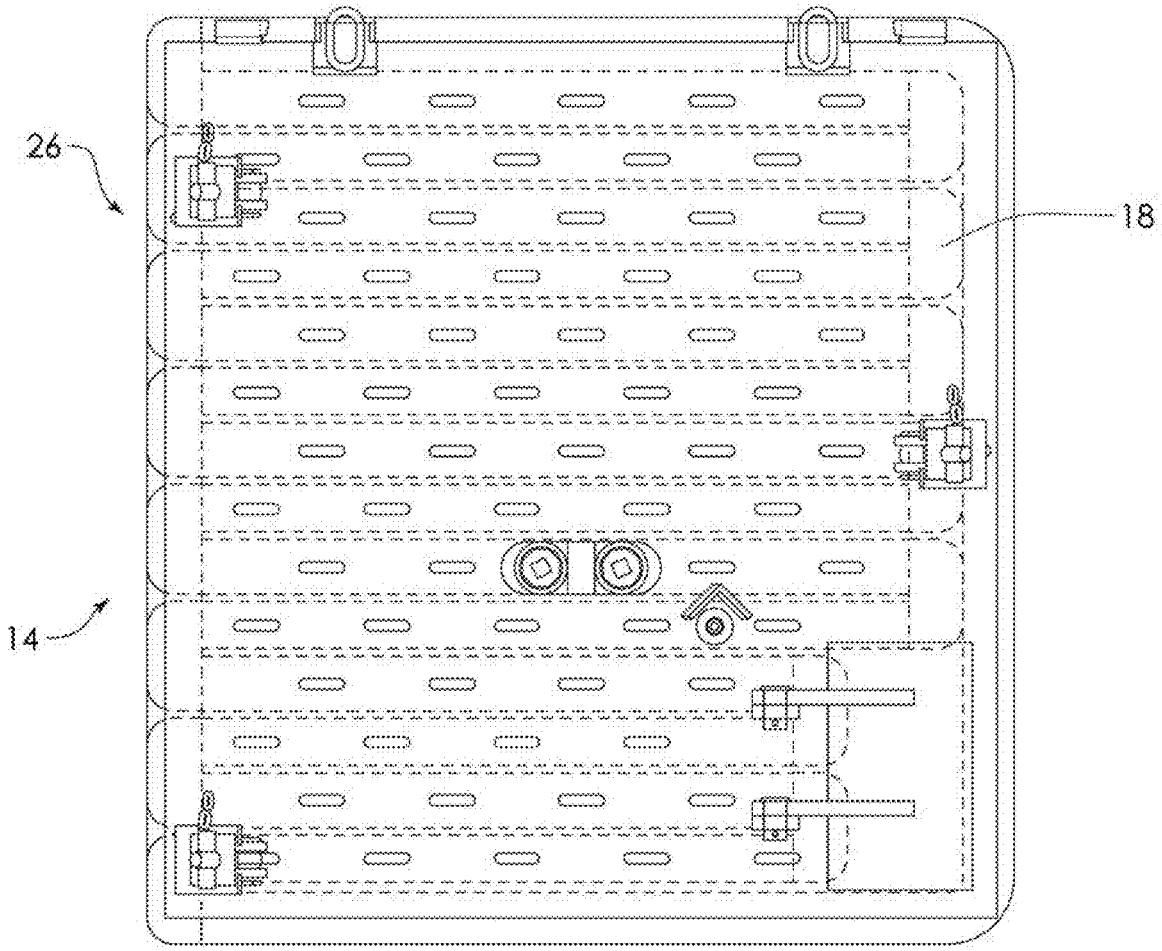
FIGS. 3A-3B are top and side views respectively of a side wall panel 40 with a high-emissivity/high-reflectivity layer 18 disposed thereon according to an embodiment of the present design.
Figure 3B:
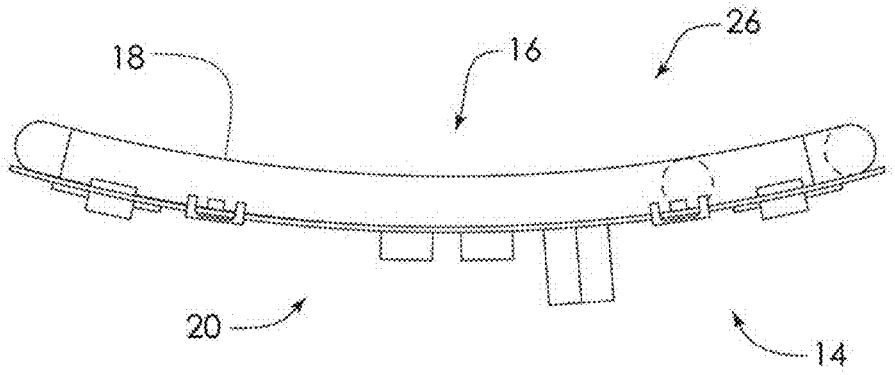

The components 14 of an electric arc or ladle furnace that may have a high emissivity/high reflectivity layer taken from the group consisting of a water-cooled panel 40, a duct 34, roof 12 frame 38, pipes, dry delta 36, water-cooled delta 28, fourth hole elbow 32, fourth hole roof 42, and combinations thereof. FIGS. 3A-3B are top and side views respectively of a side wall panel 26 with a high-emissivity/high-reflectivity layer 18 disposed thereon according to an embodiment of the present design. The side view of FIG. 3B shows the hot side 14 and the cool side 20.

Figure 4A:
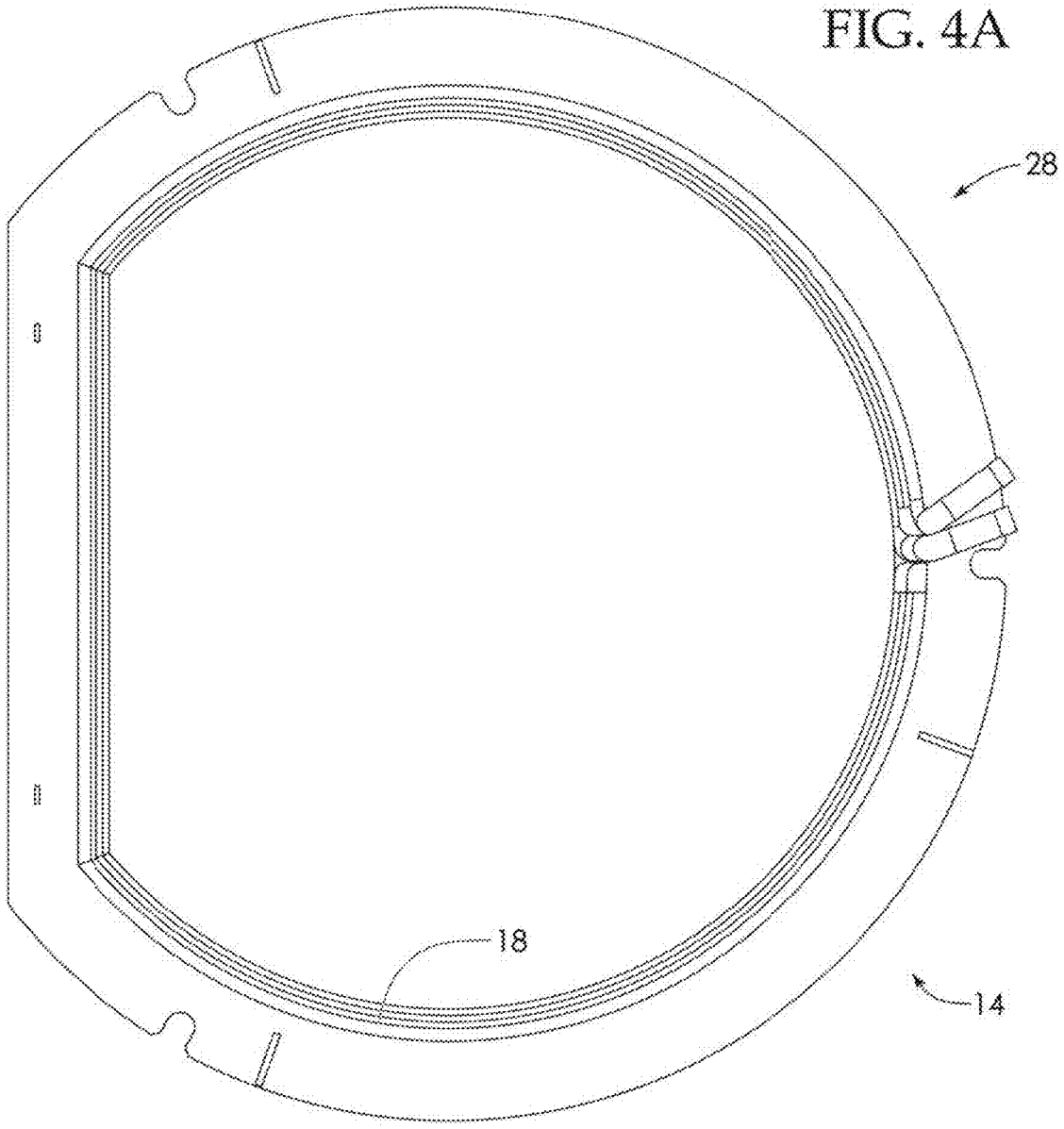
FIGS. 4A-4B are top and side views respectively of a water-cooled delta 28 with a high-emissivity/high-reflectivity layer 18 disposed thereon according to an embodiment of the present design.
Figure 4B:
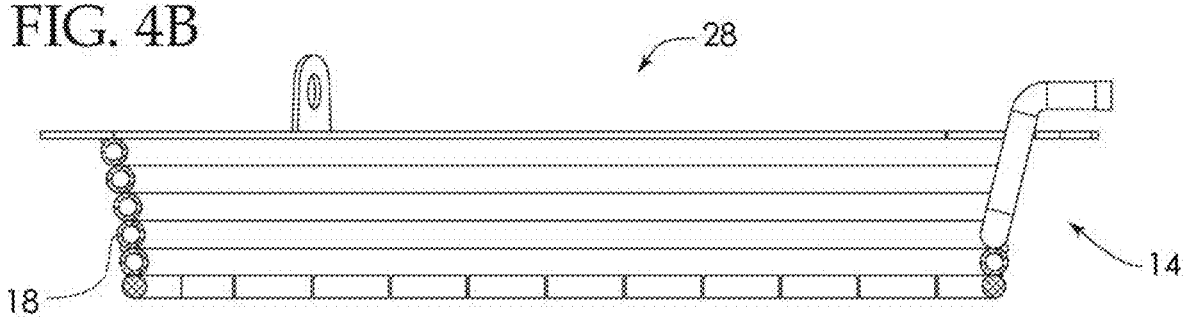
Figure 7A:
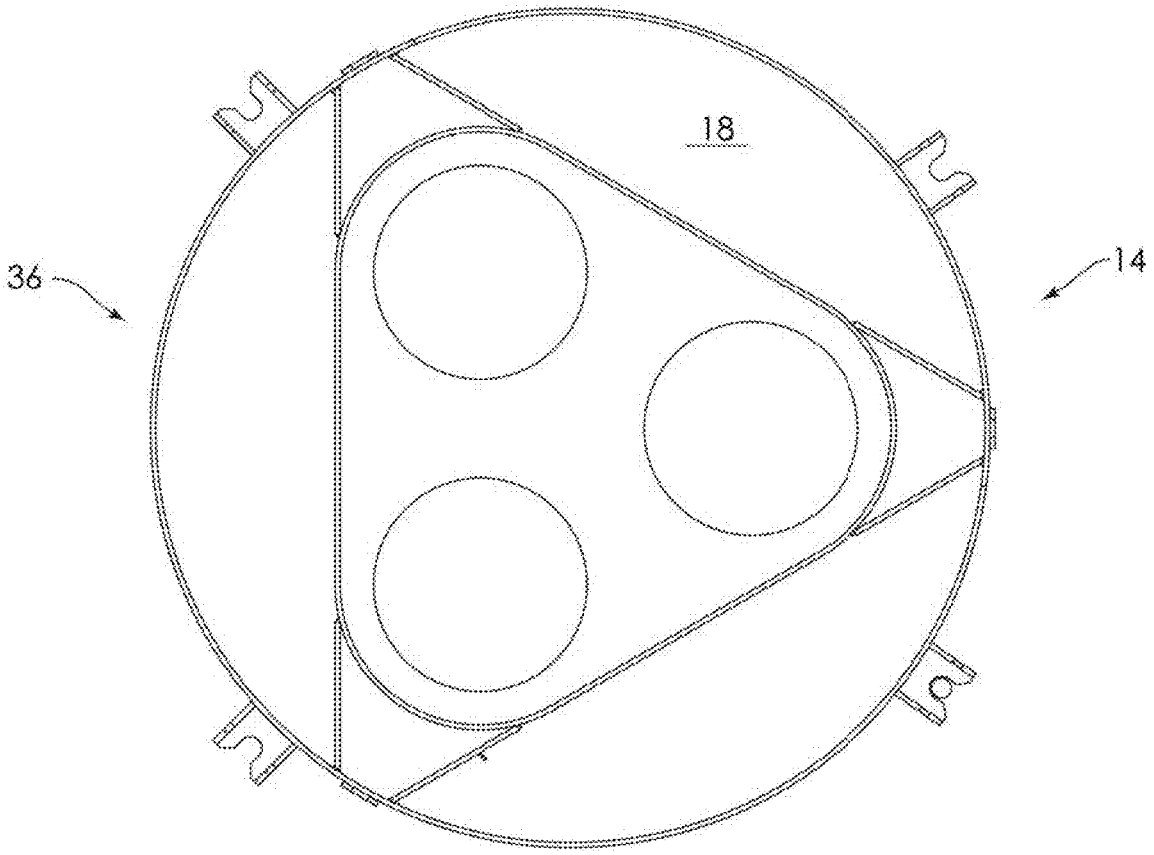
FIGS. 7A-7B are top and side views respectively of a dry delta 36 with a high-emissivity/high-reflectivity layer 18 disposed thereon according to an embodiment of the present design.
Figure 7B:
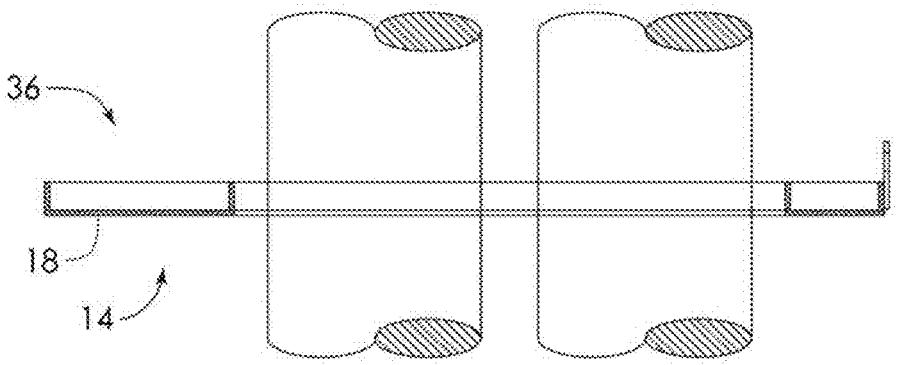

FIGS. 4A-4B are top and side views respectively of a water-cooled delta 28 with a high-emissivity/high-reflectivity layer 18 disposed thereon according to an embodiment of the present design. FIGS. 7A-7B are top and side views respectively of a dry delta 36 with a high-emissivity/high-reflectivity layer 18 disposed thereon according to an embodiment of the present design.

Figure 5A:
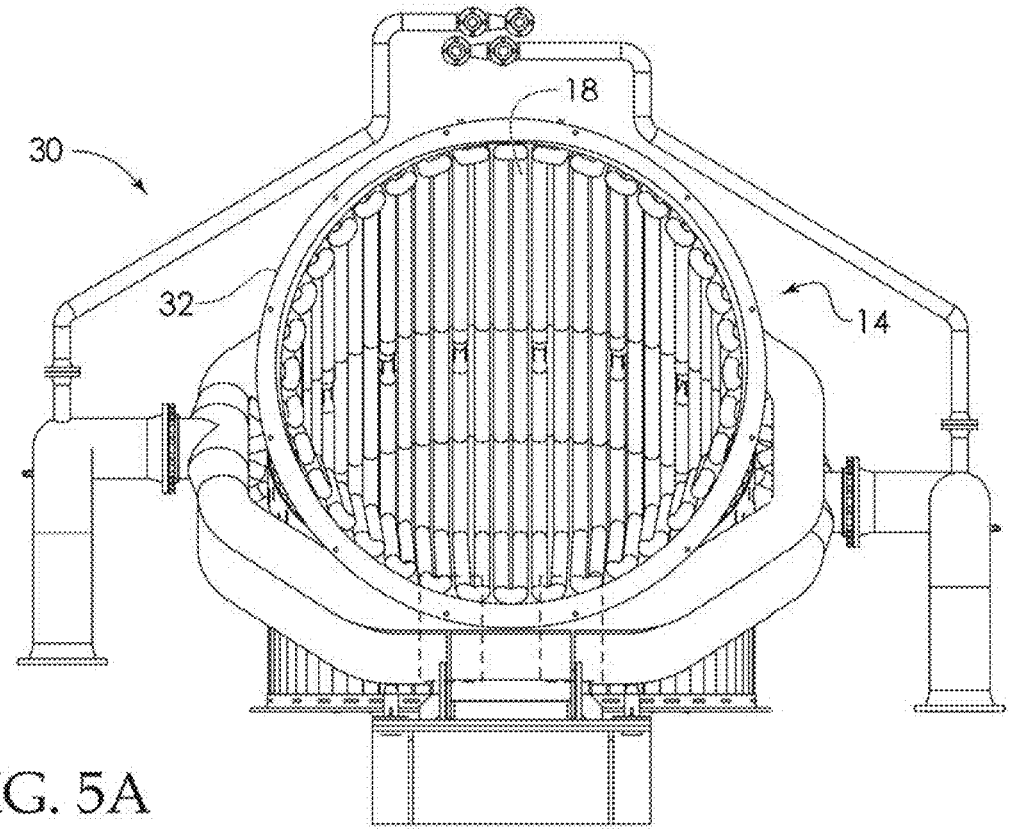
FIGS. 5A-5B are front and side views respectively of a fourth hole elbow 32 with a high-emissivity/high-reflectivity layer 18 disposed thereon according to an embodiment of the present design.
Figure 5B:
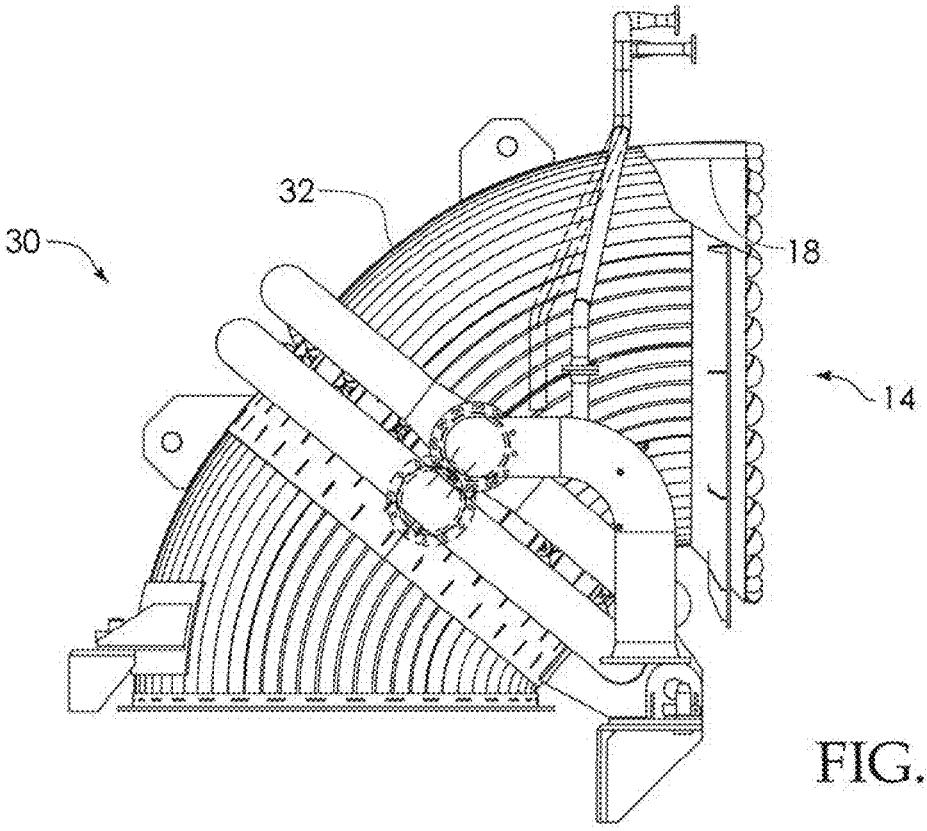
Figure 6A:
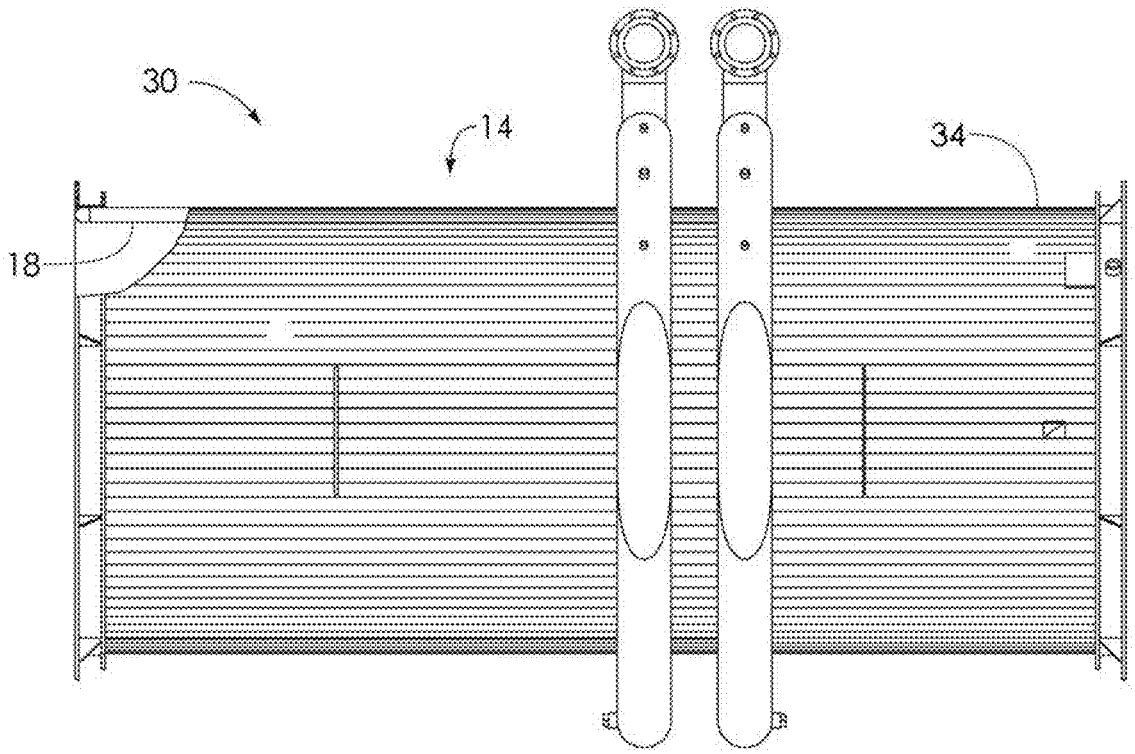
FIGS. 6A-6B are front and side views respectively of a duct 34 with a high-emissivity/high-reflectivity layer 18 disposed thereon according to an embodiment of the present design.
Figure 6B:
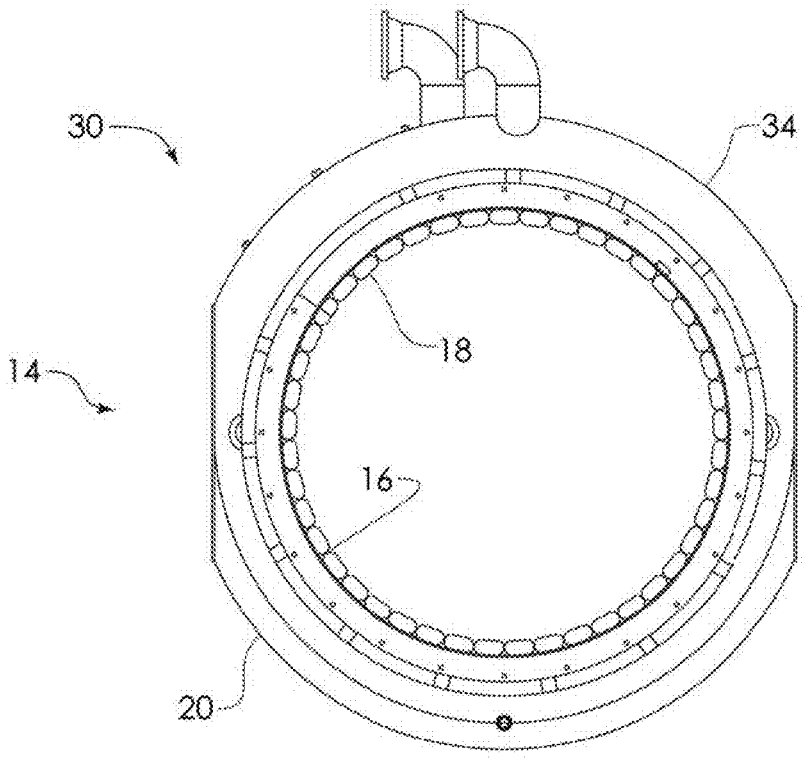

FIGS. 5A-5B are front and side views respectively of a hole elbow 32 with a high-emissivity/high-reflectivity layer 18 disposed thereon according to an embodiment of the present design. FIGS. 6A-6B are front and side views respectively of a duct 34 with a high-emissivity/high-reflectivity layer 18 disposed thereon according to an embodiment of the present design.

Figure 8A:
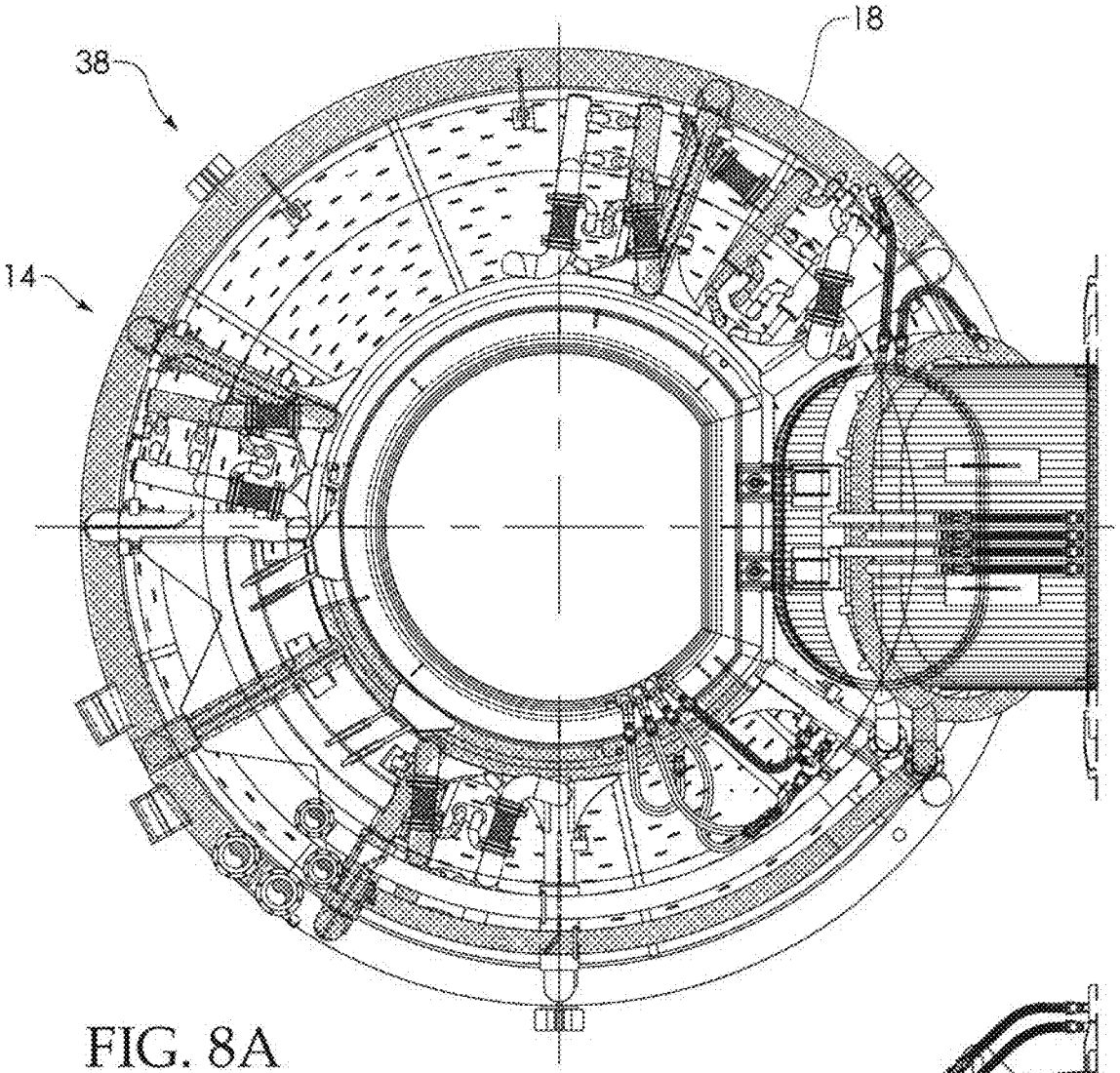
FIGS. 8A-8B are top and side views respectively of a typical roof 12 frame 38 (with panels 40) having a high-emissivity/high-reflectivity layer 18 disposed thereon according to an embodiment of the present design.
Figure 8B:
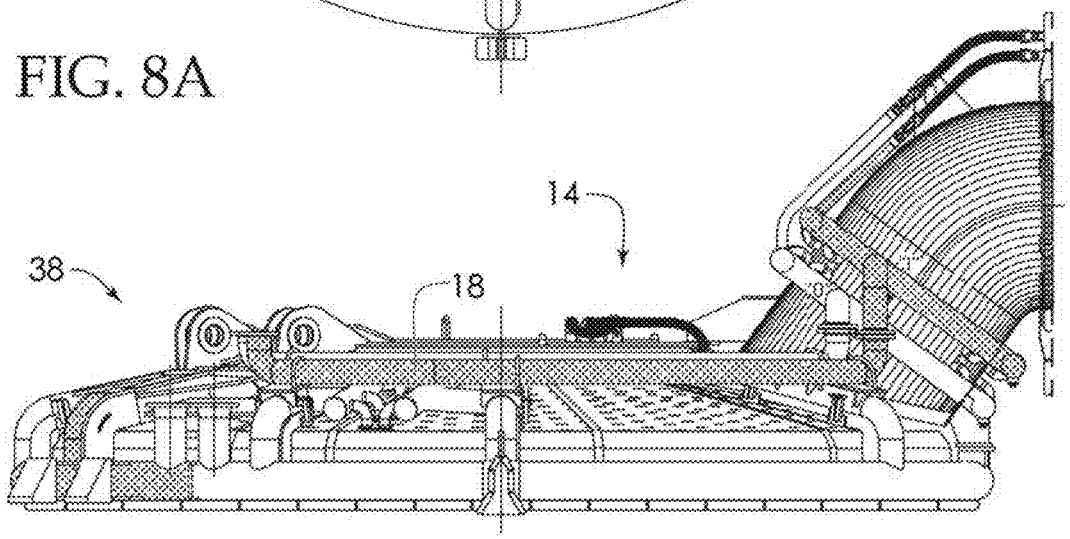

FIGS. 8A-8B are top and side views respectively of a typical roof 12 frame 38 (with panels 40) having a high-emissivity/high-reflectivity layer 18 disposed thereon according to an embodiment of the present design.

Figure 9A:
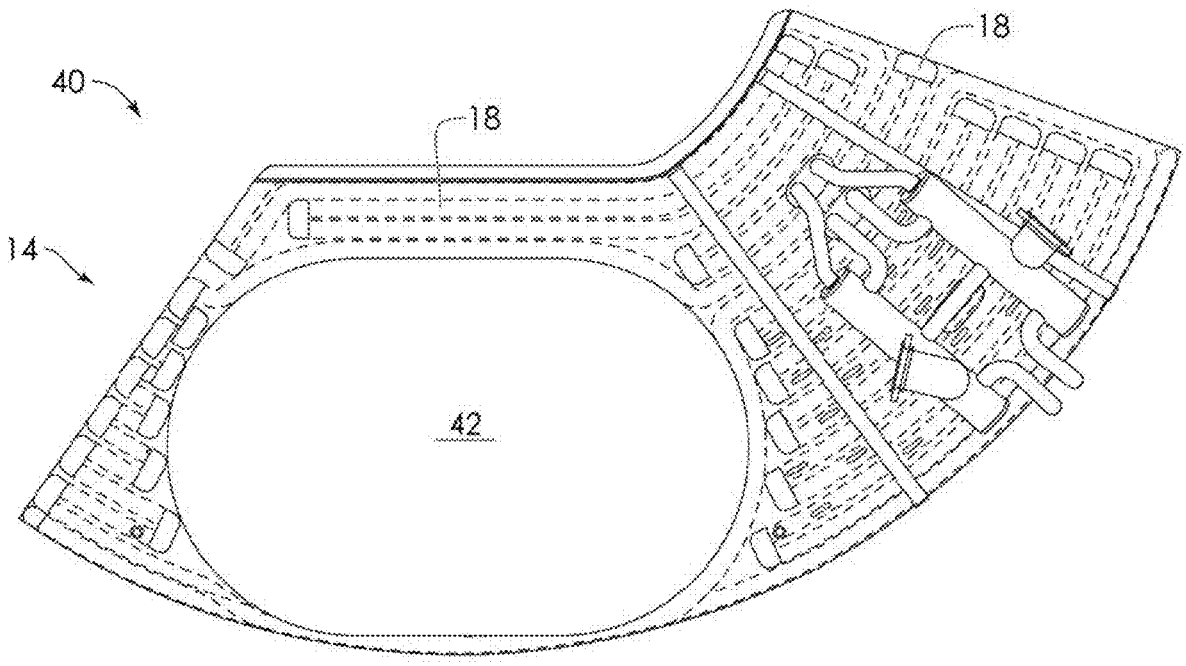
FIGS. 9A-9B are top and side views respectively of a fourth hole 42 roof 12 panel 40 with a high-emissivity/high-reflectivity layer 18 disposed thereon according to an embodiment of the present design.
Figure 9B:
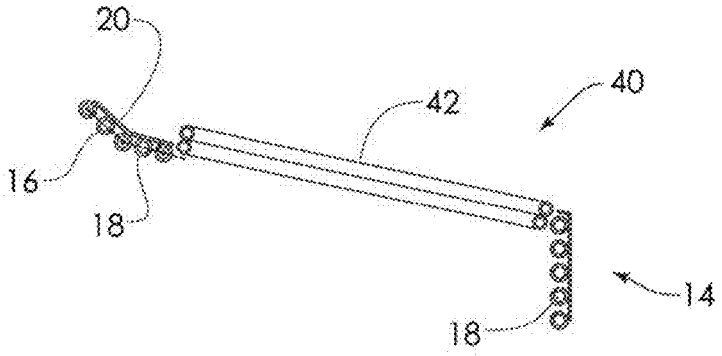
Figure 10A:
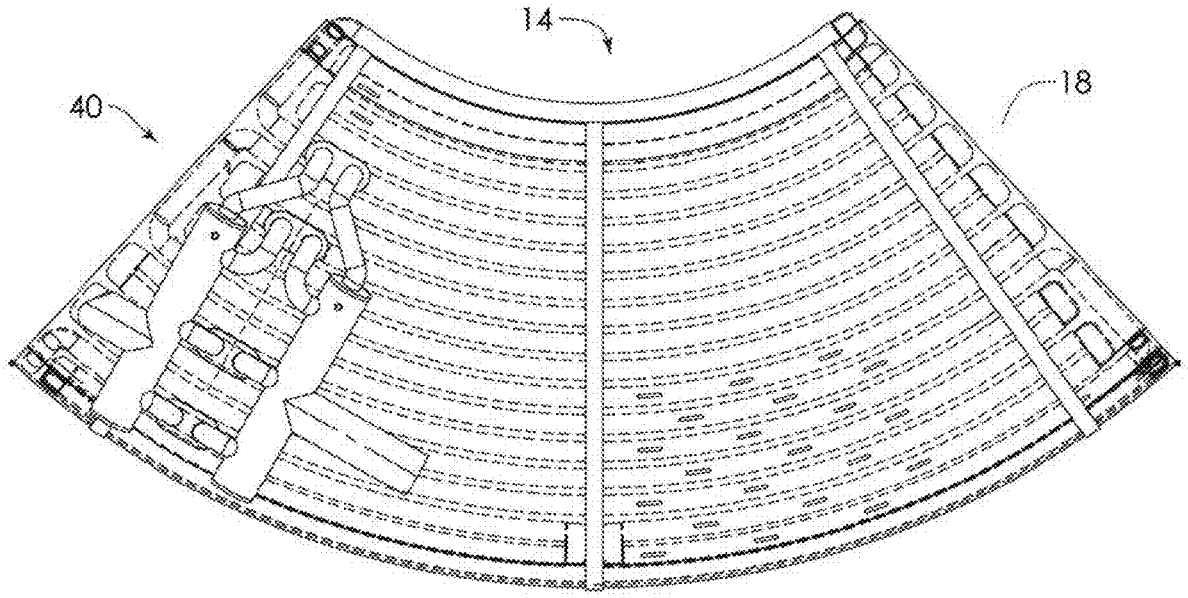
FIGS. 10A-10B are top and side views respectively of a typical roof 12 panel 40 with a high-emissivity/high-reflectivity layer 18 disposed thereon according to an embodiment of the present design.
Figure 10B:
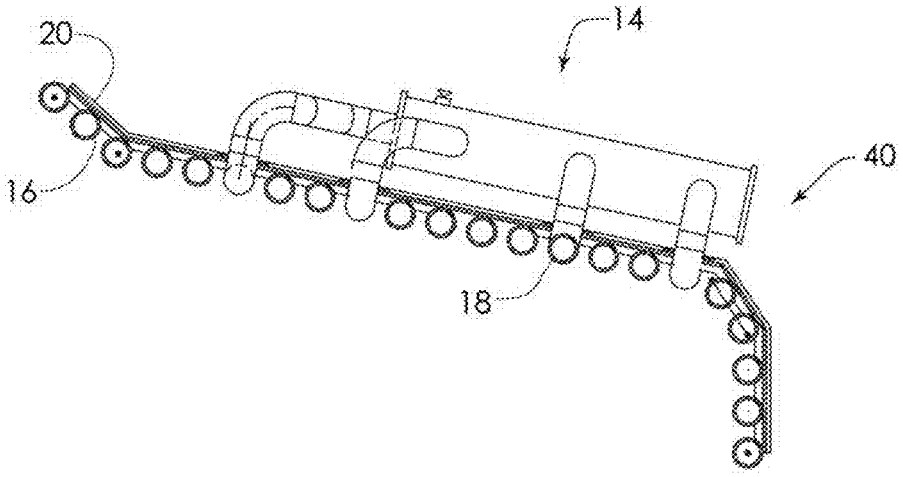

FIGS. 9A-9B are top and side views respectively of a fourth hole 42 roof 12 panel 40 with a high-emissivity/high-reflectivity layer 18 disposed thereon according to an embodiment of the present design. FIGS. 10A-10B are top and side views respectively of a typical roof 12 panel 40 with a high-emissivity/high-reflectivity layer 18 disposed thereon according to an embodiment of the present design.

A method for modifying one or more hot surfaces of at least one component 14 of an electric arc or ladle furnace involves preparing the surface of the water-cooled panel 40, which may be selected from the group comprising but not limited to: cleaners to the surface, by mechanical cleaning, or grit blasting, or combinations thereof, so that a clean surface completely free of impurities, slag or any other material is obtained.

The high emissivity/high reflectivity coating composition comprised of, in wet admixture, contains from about 5% to about 40% of an inorganic adhesive taken from the group consisting of an alkali/alkaline earth metal silicate taken from the group consisting of sodium silicate, potassium silicate, calcium silicate, and magnesium silicate; from about 23% to about 56% of a filler taken from the group consisting of silicon dioxide, aluminum oxide, titanium dioxide, magnesium oxide, calcium oxide, and boron oxide; and from about 0.5% to about 16% of one or more emissivity agents taken from the group consisting of silicon hexaboride, boron carbide, silicon tetraboride, silicon carbide (powder), molybdenum disilicide, cerium oxide, tungsten disilicide, zirconium diboride, zirconium carbide, hafnium carbide, hafnium diboride, cupric chromite, and metallic oxides; and from about 18% to about 50% water. Additionally, from about 0.5% to about 2.4% of a stabilizer taken from the group consisting of bentonite, kaolin, magnesium alumina silica clay, tabular alumina, and stabilized zirconium oxide may be included in the wet admixture. Optionally, up to about 1.0% of a surfactant may be added.

Applying the coating over the surface prepared in surface preparing step by spraying using pneumatic guns, vacuum deposition, an high volume low pressure spray gun, high volume low pressure spray gun, or an airless spray gun, or other "airless" systems that use a piston system to apply the material without introducing air into the process.

The coating composition has the following properties: Thermal conductivity: of 1.4 W/m/K at 350° C., Emissivity of 0.85 to 0.95 at 2000° F., and a Dielectric constant of K=3.9 at 1 HZ.

It is to be understood that the present invention is not limited to the embodiments described above, but encompasses any and all embodiments within the scope of the following claims.

What is claimed is:

1. A component for an electric arc or ladle furnace having one or more surfaces facing a hot portion of the furnace, comprising:

the surfaces have a high emissivity layer, having the properties of

Thermal conductivity of 1.4 W/m/K at 350° C.;

Emissivity of 0.85 to 0.95 at 2000° F.; and

Dielectric constant of K=3.9 at 1 HZ; wherein the component surfaces of an electric arc or ladle furnace is taken from the group consisting of surfaces of a water-cooled panel, a duct, roof frame, pipes, dry delta, water-cooled delta, fourth hole elbow, side walls, fourth hole roof, and combinations of the surfaces thereof.

2. The component of claim 1, wherein:

the high emissivity/high reflectivity layer has a thickness of about 1 mils to about 3 mils (25μ to 75μ).

3. The component of claim 1, wherein:

the high-emissivity/high-reflectivity layer comprises, in dry admixture, from about 5% to about 40% of an inorganic adhesive taken from the group consisting of an alkali/alkaline earth metal silicate taken from the group consisting of sodium silicate, potassium silicate, calcium silicate, and magnesium silicate;

from about 45% to about 80% of a filler taken from the group consisting of silicon dioxide, aluminum oxide, titanium dioxide, magnesium oxide, calcium oxide, and boron oxide; and from about 1% to about 25% of one or more emissivity agents taken from the group consisting of silicon hexaboride, boron carbide, silicon tetraboride, silicon carbide (powder), molybdenum disilicide, cerium oxide, tungsten disilicide, zirconium diboride, zirconium carbide, hafnium carbide, hafnium diboride, cupric chromite, and metallic oxides.

4. The component of claim 1, wherein:

the emissivity agents are one or more metallic oxides taken from the group consisting of iron oxide, magnesium oxide, manganese oxide, copper chromium oxide, chromium oxide, cerium oxide, terbium oxide, and derivatives thereof.

5. The component of claim 3, wherein:

the filler is a fine particle size refractory material taken from the group consisting of silicon dioxide, aluminum oxide, titanium dioxide, magnesium oxide, calcium oxide and boron oxide.

6. The component of claim 3, wherein:

the emissivity agent(s) is (are) taken from the group consisting of silicon hexaboride, boron carbide (also known as carbon tetraboride), silicon tetraboride, silicon carbide, molybdenum disilicide, tungsten disilicide, zirconium diboride, cupric chromite, and, combinations and derivatives thereof.

7. The component of claim 3, wherein:

metallic oxides taken from the group consisting of iron oxides, magnesium oxides, manganese oxides, copper chromium oxides, chromium oxides, cerium oxides, terbium oxides, and combinations thereof.

8. The component of claim 3, wherein:

the high-emissivity/high-reflectivity layer further comprises, in dry admixture, from about 1.5% to about 5.0% of a stabilizer taken from the group consisting of bentonite, kaolin, magnesium alumina silica clay, tabular alumina, and stabilized zirconium oxide.

9. The component of claim 6, wherein:

the stabilizer is preferably bentonite.

10. An electric arc or ladle furnace, comprising:

a component for an electric arc or ladle furnace having one or more hot surface substrates facing a hot portion of the furnace, wherein the hot surface substrates have a high emissivity layer, having the properties of Thermal conductivity of 1.4 W/m/K at 350° C.;

Emissivity of 0.85 to 0.95 at 2000° F.; and

Dielectric constant of K=3.9 at 1 HZ; wherein the component surfaces of an electric arc or ladle furnace is taken from the group consisting of surfaces of a water-cooled panel, a duct, roof frame, pipes, dry delta, water-cooled delta, fourth hole elbow, dry delta, fourth hole roof, side walls, and combinations of the surfaces thereof.

11. The component of claim 10, wherein:

the high emissivity/high reflectivity layer has a thickness of about 1 mils to about 3 mils (25μ to 75μ).

12. The component of claim 10, wherein:

the high emissivity/high reflectivity layer comprises, in dry admixture, from about 5% to about 40% of an inorganic adhesive taken from the group consisting of an alkali/alkaline earth metal silicate taken from the group consisting of sodium silicate, potassium silicate, calcium silicate, and magnesium silicate;

from about 45% to about 80% of a filler taken from the group consisting of silicon dioxide, aluminum oxide, titanium dioxide, magnesium oxide, calcium oxide, and boron oxide; and from about 1% to about 25% of one or more emissivity agents taken from the group consisting of silicon hexaboride, boron carbide, silicon tetraboride, silicon carbide (powder), molybdenum disilicide, cerium oxide, tungsten disilicide, zirconium diboride, cupric chromite, and metallic oxides.

13. The component of claim 10, wherein:

the emissivity agents are one or more metallic oxides taken from the group consisting of iron oxide, magnesium oxide, manganese oxide, copper chromium oxide, chromium oxide, cerium oxide, terbium oxide, and derivatives thereof.

14. The component of claim 12, wherein:

the high-emissivity/high-reflectivity layer composition further comprising: water forming a wet admixture having a total solids content ranges from about 40% to about 70%.

15. The component of claim 12, wherein:

the filler is a fine particle size refractory material taken from the group consisting of silicon dioxide, aluminum oxide, titanium dioxide, magnesium oxide, calcium oxide and boron oxide.

16. The component of claim 12, wherein:

the emissivity agent(s) is (are) taken from the group consisting of silicon hexaboride, boron carbide (also known as carbon tetraboride), silicon tetraboride, silicon carbide, molybdenum disilicide, tungsten disilicide, zirconium diboride, cupric chromite, and, combinations and derivatives thereof.

17. The component of claim 12, wherein:

metallic oxides taken from the group consisting of iron oxides, magnesium oxides, manganese oxides, copper chromium oxides, chromium oxides, cerium oxides, terbium oxides, and combinations thereof.

18. The component of claim 12, wherein:

the high-emissivity/high-reflectivity layer further comprises, in dry admixture, from about 1.5% to about 5.0% of a stabilizer taken from the group consisting of bentonite, kaolin, magnesium alumina silica clay, tabular alumina, and stabilized zirconium oxide.

19. The component of claim 18, wherein:

the stabilizer is preferably bentonite.

* * * * *